US009132954B2

(12) United States Patent
Nilsson et al.

(10) Patent No.: US 9,132,954 B2
(45) Date of Patent: Sep. 15, 2015

(54) FLUID RESERVOIR, A SYSTEM FOR FLUID SUPPLY COMPRISING SAID RESERVOIR AND USE OF SAID RESERVOIR IN A SYSTEM FOR SUPPLY OF INK TO AN INK JET PRINTER

(71) Applicant: INKIT AB, Gothenburg (SE)

(72) Inventors: Per Nilsson, Hono (SE); Rolf Andersson, Bro (SE)

(73) Assignee: Inkit AB, Gothenburg (SE)

( * ) Notice: Subject to any disclaimer, the term of this patent is extended or adjusted under 35 U.S.C. 154(b) by 0 days.

(21) Appl. No.: 14/354,725

(22) PCT Filed: Oct. 29, 2012

(86) PCT No.: PCT/SE2012/051175

§ 371 (c)(1),
(2) Date: Apr. 28, 2014

(87) PCT Pub. No.: WO2013/062480

PCT Pub. Date: May 2, 2013

(65) Prior Publication Data

US 2014/0263431 A1 Sep. 18, 2014

(30) Foreign Application Priority Data

Oct. 29, 2011 (SE) ..... 1130105

(51) Int. Cl.
*B41J 2/175* (2006.01)
*B65D 83/42* (2006.01)

(52) U.S. Cl.
CPC *B65D 83/42* (2013.01); *B41J 2/175* (2013.01)

(58) Field of Classification Search
USPC ..... 347/7, 84, 85, 86, 87; 222/61, 92, 94, 222/394, 395, 581
See application file for complete search history.

(56) References Cited

U.S. PATENT DOCUMENTS

| | | | | |
|---|---|---|---|---|
| 6,485,137 | B2 * | 11/2002 | Karlinski et al. | 347/92 |
| 7,404,628 | B2 * | 7/2008 | Naka et al. | 347/86 |
| 7,547,097 | B2 * | 6/2009 | Tsukada et al. | 347/85 |
| 8,454,136 | B2 * | 6/2013 | Katoh et al. | 347/85 |
| 2007/0081052 | A1 | 4/2007 | Lebron et al. | |
| 2008/0231650 | A1 | 9/2008 | Kojima et al. | |
| 2010/0079562 | A1 | 4/2010 | Katada | |

FOREIGN PATENT DOCUMENTS

JP 2008238433 A 10/2008

OTHER PUBLICATIONS

International Search Report corresponding to International Application No. PCT/SE2012/051175 mailed Feb. 15, 2013.

* cited by examiner

*Primary Examiner* — Anh T. N. Vo
(74) *Attorney, Agent, or Firm* — Myers Bigel Sibley & Sajovec, P.A.

(57) ABSTRACT

The present invention relates to a fluid reservoir (21), said fluid reservoir (21) comprising at least one first cavity (29) and one second cavity (30) in fluidic communication with each other and adapted to accommodate fluid (7), the fluid reservoir (21) further being connected to a fluid-container system (7, 8, 9, II, 22), a fluid consumer (5) in fluidic communication with at least the second cavity (30), a pressurization system (I, 2) adapted to generate a substantially constant pressure, and a vacuum system (58, 59, 60) adapted to generate a pressure below ambient pressure. The invention further comprises a fluid-supply system.

24 Claims, 4 Drawing Sheets

FLUID RESERVOIR, A SYSTEM FOR FLUID SUPPLY COMPRISING SAID RESERVOIR AND USE OF SAID RESERVOIR IN A SYSTEM FOR SUPPLY OF INK TO AN INK JET PRINTER

RELATED APPLICATIONS

This application is a 35 U.S.C. §371 national stage application of PCT International Application No. PCT/SE2012/051175, filed on Oct. 29, 2012, which claims priority from Swedish Application No. 1130105-8, filed on Oct. 29, 2011, the contents of which are incorporated herein by reference in their entireties. The above-referenced PCT International Application was published as International Publication No. WO 2013/062480 A1 on May 2, 2013.

FIELD OF THE INVENTION

This invention relates to a fluid reservoir, primarily for use with inkjet printers. More specifically, the present invention relates to a fluid reservoir for use in a fluid-supply system particularly suitable for use with ink jet printers of the kind in which the ink droplets are ejected on demand, so-called "drop-on-demand" inkjet printers. The "drop-on-demand" inkjet printers can, for example, be of the types "valve jet", "Solenoid", MEMS or "piezo jet". The main use of an inkjet printer is to print information on various surfaces. A common application is to indicate expiration date, batch number and similar information on goods produced in industry. Inkjet printers also have other applications where the application of an exact amount of fluid with high precision is desired, such as in the application of glue. Inkjet printers of the "valve jet" type are described in more detail in U.S. Pat. No. 4,736,774 and SE 860-5348-5. Inkjet printers of the "piezo jet" type are described in more detail in U.S. Pat. No. 4,825,227, U.S. Pat. No. 7,052,117, U.S. Pat. No. 4,992,808, U.S. Pat. No. 6,616,018, U.S. Pat. No. 4,459,601 and WO/92/10367. Disclosure of these patents is incorporated herein by reference. This fluid-supply system may additionally have other applications where its characteristics are desirable.

TECHNICAL BACKGROUND

In the following, the term "ink system" is generally used to designate a fluid-supply system. These designations are used synonymously. The term "ink", as used in the following, is intended to include even other fluids for marking, painting or printing, as well as their cleaning and diluting fluids. The term "packaging" refers to the bottle, jug or vessel, or bag, in which the ink is supplied to the user of the inkjet printer. The term "controlled pressure" refers to the fact that the pressure level and its variation are in accordance with the relevant requirements. The present invention can either provide an inkjet printer with ink directly from a packaging, or provide an inkjet printer of the "piezo jet" type with ink via a non-pressurized reservoir. The term fluid consumer refers to, for example, an inkjet printer or other equipment to be fed with fluid, such as a gluing machine fed with glue.

There are several known designs of ink systems for inkjet printers. The principles of transport are pressurization with air, a fluid pump, gravity and capillary forces, or a combination of these. One common method is pressurizing the ink using air. An advantage of pressurization using air is the possibility to easily obtain a controlled ink pressure to an inkjet printer, which is a characteristic very important to inkjet printers in order to obtain a uniform droplet size. One advantage is that the ink system can be made simple. Pressurization can be achieved using an air pump or an external source of compressed air. One problem with pressurization using air is that it requires packaging that withstands pressurization. This places high demands on the packaging, which must be of very robust design. That makes it expensive, and especially harmful from an environmental point of view due to its large amount of material. To a certain extent, the requirements for robustness can be alleviated by placing the packaging in a mounting bracket of some kind, designed so as to provide the packaging with external support. This results in the mounting bracket absorbing some of the pressure on the packaging. Pressurization also means either that the packaging must comply with the legal requirements for a pressure vessel, or that the pressure must be reduced in order to evade legal requirements. This implies a need to introduce costly and complicated pressure-relief valves to ensure that the packaging is never exposed to excessive pressure. A common way to reduce the requirements for the packaging is to place it in what can be described as a pressure chamber. In this way, the packaging itself is not pressurized, but the pressure chamber results in increased costs. The pressure chamber must meet or evade legal requirements for pressure vessels. One problem which arises when reducing the maximum pressure in order to evade legal requirements for pressure vessels is that the inkjet printer is not provided with sufficient pressure for good print quality. In particular, this is a problem if the packaging is located far below the inkjet printer, more than 1.5 meters, as 0.1 bar of pressure is lost for each meter of elevation. Furthermore, one problem with pressurisation is the need to ensure that the air is very clean in order not to contaminate the ink. Another problem is that the ink may be over-saturated with air. This air can then be released inside the inkjet printer, creating printing problems. Some inkjet-printer technologies, such as "piezo jet", are particularly sensitive to this. A known solution for avoiding the above problems is to use, as an alternative, fluid pumps which draw the ink from the packaging by suction. This imposes no requirements on the packaging, other than that it must be approved for transporting the goods it contains. One problem with the fluid pumps currently used is that it is very difficult to obtain a controlled pressure. Pumps often deliver an excessive and irregular pressure. A known solution is to use shunts and pulsation dampers to obtain an acceptable controlled pressure. The shunt serves to adjust the level of pressure as well as to dampen pressure fluctuations. A pulsation damper further equalizes the pressure. Yet another problem is that pumps often have the disadvantage that they may cause cavitation, thereby creating bubbles. These bubbles may completely or partially block conduits, thereby deteriorating the print quality. Cavitation occurs during pumping of a fluid, if, in the suction phase, a pressure below ambient pressure is produced which is strong enough to make the static pressure of the fluid drop to the vapour pressure of the fluid. The fluid then locally passes into gaseous form. The pumps normally used pump small volumes at a high frequency to achieve a sufficient flow; they can be said to have a small displacement, i.e., pump a small volume per cycle. This means they pump using a pressure in the suction phase which is significantly lower than the ambient pressure and therefore have a tendency to produce cavitation. One additional problem is that pumps and shunts generate high shear forces which may destroy sensitive components of the ink. This problem is further accentuated by the ink circulating several times through the pump and shunt. Pumps are mostly electrically powered, which is unsuitable for pumping common flammable inks, or if the ink system must be installed in environments that may be explosive. The problem of installing an electrically powered ink system in environments that may be explosive can be solved by installing the equipment in an explosion-proof cabinet. However, this entails non-negligible additional costs. One method of emptying the packaging can be to hang it from a suspension device above the inkjet printer, whereby it is emptied by way of gravity. One problem is that the packaging must be placed unreasonably high, more than 4 m above, for a desired ink pressure to be obtained. Another problem is that the packaging may be heavy to lift if it is large. Yet another problem is that it is cumbersome to adjust the pressure.

SUMMARY OF THE INVENTION

Specific and characteristic to the invention is the attainment, by way of a suction principle, of a controlled pressure achieved by a fluid reservoir with a pressure-retaining function according to the invention.

The object of the invention is to provide an apparatus for supplying ink to an inkjet printer head wherein at least part of the disadvantages of the prior art are avoided. The invention is therefore to fulfil at least one of the following purposes:

- Having a suction principle, which means a greater choice of packaging and allows the use of the more environmentally friendly so-called "bag-in-box" packaging, meaning that packaging and ink system are not subject to legal requirements relating to pressure vessels.
- Obtaining sufficient pressure in order to achieve good print quality, even if the packaging is placed far below the inkjet printer.
- Providing a controlled pressure.
- The ink being fed without any contact with air. This is to avoid any contamination from air, and in order for the ink not to be saturated with air.
- Obtaining an ink system which does not cause cavitation.
- Obtaining an ink system presenting very low shear forces.
- Obtaining an ink system where electricity and ink are separated, which also means that the ink system can be placed in an environment that may be explosive.

Furthermore, it is also desirable to achieve additional objects:

- That the packaging can be replaced without interrupting the pressurization of the inkjet printer, which can thus print without interruption.
- That ink can be transported which is apt to react with air and that the low gas content can be maintained in so-called degassed inks. However, this requires a packaging which is either a collapsible bag, such as a so-called "bag-in-box" packaging, or a rigid packaging, where a shielding gas is supplied.
- That ink can be can degassed.

DETAILED DESCRIPTION OF THE DRAWINGS

Figure 1:
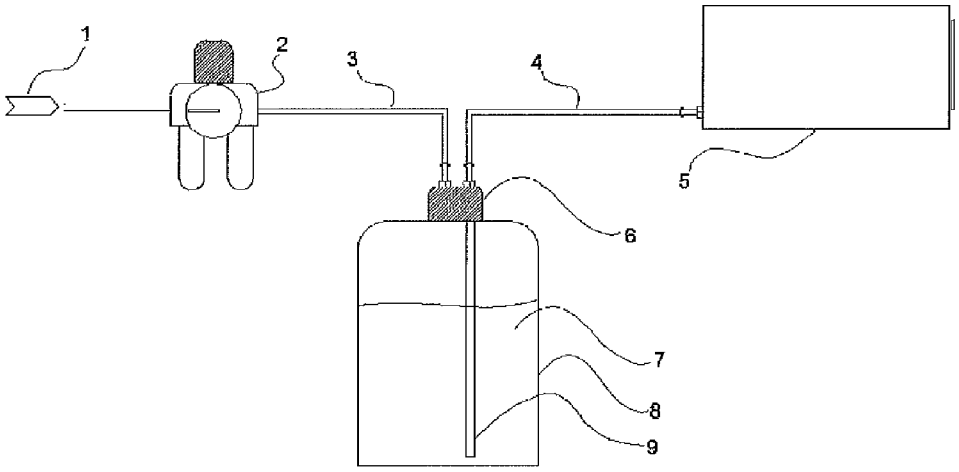
FIG. 1 shows an air-pressurized ink system supplying a prior art inkjet printer.

FIG. 1 shows an ink system with a pressurized packaging of prior art, which provides an inkjet printer 5 with ink. Compressed air is obtained from an external compressed-air source 1, typically 4-10 bar. In a pressure regulator 2, the pressure is down-regulated to the desired working pressure, typically around 0.35-1.00 bar, which pressurizes, via an air hose 3 and a cover 6, a packaging 8. Ink 7 is pressed out of the packaging 8 via a lance 9 and a cover 6 to a hose 4 which feeds ink with a controlled pressure to an inkjet printer 5.

Figure 2:
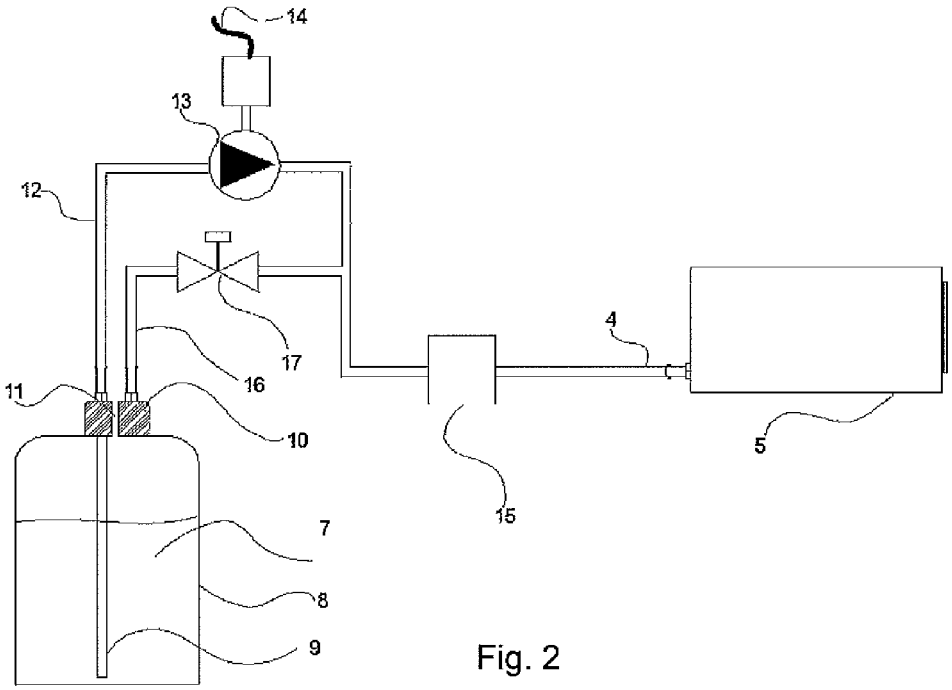
FIG. 2 shows an ink system with a fluid pump, a shunt and a pulsation damper supplying a prior art inkjet printer.

FIG. 2 shows a suction-type ink system with a fluid pump of prior art, providing an inkjet printer 5 with ink. The pump and motor 13 connected to a voltage source 14 draw ink 7 from a packaging 8 via a lance 9, a cover 10, a hose 12 and a pulsation damper 15 to equalize the pressure variations of the pump to a hose 4 feeding ink with a controlled pressure to an inkjet printer 5. The pressure is adjusted by a shunt 17 through regulation of the return flow of ink 16 to the packaging. The cover 10 has a conduit 11 communicating with the surrounding atmosphere in order to avoid the development of a pressure below ambient pressure in the packaging 8 as ink is being drawn out. There are further (not shown) variants of embodiments with a pump. One example is where the shunt is located above the pump, thus being different from FIG. 2, where there is a return line to the packaging.

In FIG. 1 and FIG. 2, filters have been omitted because they have nothing to do with the functional principle, and because they can have several alternative locations. Examples of locations of the ink filters are directly before the print head on the hose 4, and an air filter on the conduit 11.

The demands for controlled pressure of an inkjet printer of the "piezo jet" type are so extreme that a reservoir on the same level as, and adjacent to, the print head is always required. It is then the reservoir that is required to provide the inkjet printer with a controlled pressure. Here, the capillary principle is used to supply the print head with ink from the reservoir. The invention, as well as the previous principles such as pressurizing the ink using air or by gravity, or by means of a fluid pump, can be used to fill the reservoir from the packaging.

DETAILED DESCRIPTION OF THE INVENTION

The invention is explained in more detail below with reference to the embodiments illustrated in the drawings. Detailed descriptions of a preferred embodiment can be seen in FIGS. 3-6.

Figure 3:
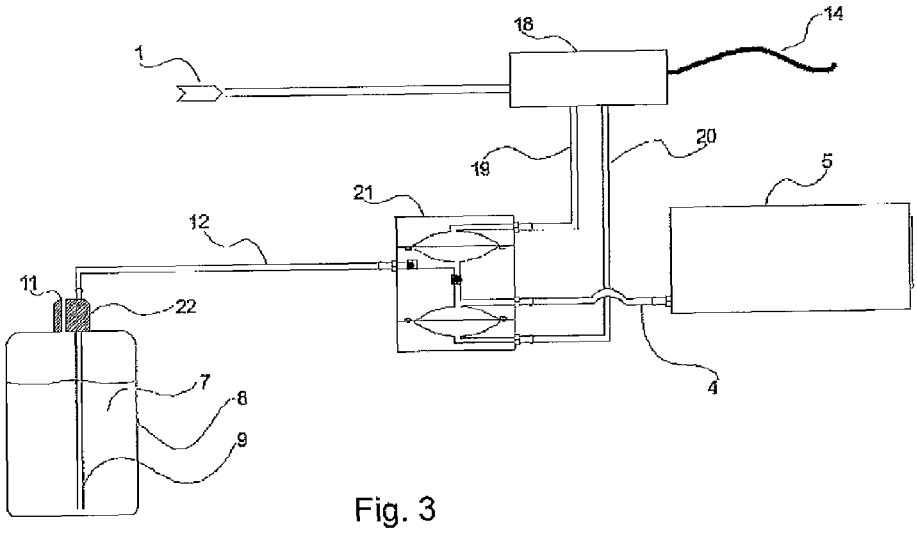
FIG. 3 shows the application of the invention wherein the invention directly supplies an inkjet printer.

FIG. 3 shows a fluid-supply system comprising an inventive fluid reservoir 21 which supplies a fluid consumer 5, in this described example an inkjet printer, with ink. The fluid reservoir 21 draws ink 7 from the packaging 8 via the lance 9, through the cover 22 and a first hose 12. The cover 22 has a conduit 11 communicating with the surrounding atmosphere in order to avoid the development of a pressure below ambient pressure in the packaging 8 as the ink 7 is being drawn out. Hereinafter, said container 8 with ink 7, lance 9, cover 22 with conduit 11 are referred to as the fluid-container system. From the fluid reservoir 21, ink 7 is forwarded with a controlled pressure via a second hose 4, to a fluid consumer 5, in this described example an inkjet printer. A control unit 18 controls the pressure and suction phases in the fluid reservoir 21 via a third hose 19 in which pressure and vacuum alternate, and a fourth hose 20 in which there is a constant pressure. This is described in detail in the explanation of FIGS. 5 and 6. Connected to the control unit 18 are a voltage source 14 and an external compressed-air source 1, typically 4-10 bar.

Figure 4:
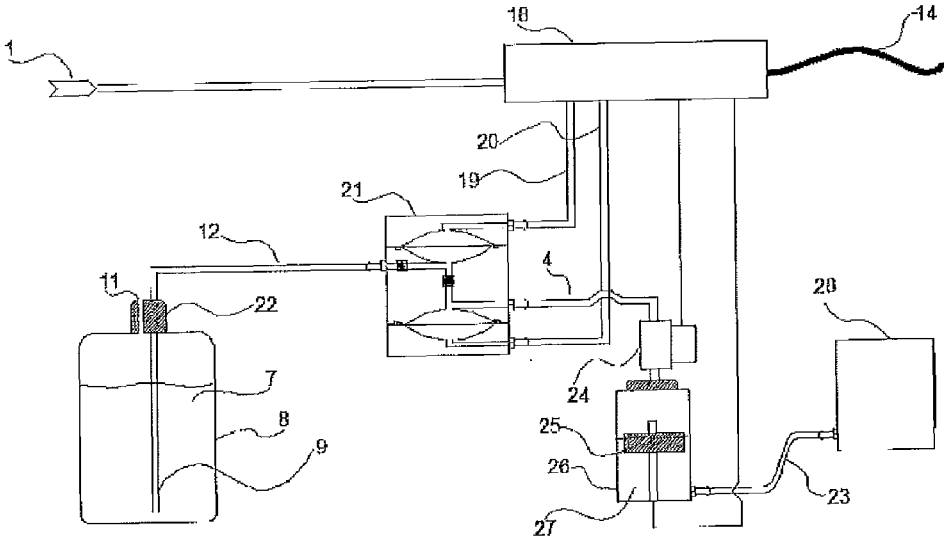
FIG. 4 shows the application of the invention wherein the invention supplies a reservoir which in turn supplies an inkjet printer.

In FIG. 4 the invention supplies a fluid consumer 5 with ink, in this described example an inkjet printer 28 of the "piezo jet" type. The fluid reservoir 21 draws ink 7 from the packaging 8 via the lance 9 through the cover 22 and a first hose 12 and forwards the ink 7 under controlled pressure via a second hose 4 to a second reservoir 26 comprising a filling sensor 25 for ink 27. An inkjet printer 28 of the "piezo jet" type draws the ink by capillary force from the reservoir 26 via a fifth hose 23. The ink level in the second reservoir 26 must be within a certain level range in relation to the inkjet printer, normally 15-40 mm below the inkjet printer. When the level in the second reservoir 26 falls below the lower ink level, the filling sensor 25 sends a signal to a control unit 18 to open a solenoid valve 24 to the second hose 4 until the upper ink level is reached. The control unit 18 controls the pressure and suction phases in the fluid reservoir 21 via a third hose 19 in which pressure and vacuum alternate, and a fourth hose 20 in which there is a constant pressure. This is described in detail in the explanation of FIGS. 5 and 6. Connected to the control unit 18 are a voltage source 14 and an external compressed-air source 1, typically 4-10 bar. The cover 22 has a conduit 11 communicating with the surrounding atmosphere in order to avoid the development of pressure below ambient pressure in the packaging 8 as the ink 7 is being drawn out.

In FIG. 3 and FIG. 4, filters have been omitted because they have nothing to do with the functional principle, and because they can have several alternative locations. Examples of locations of ink filters are directly before the print head on the second hose 4 and the fifth hose 23 respectively, and an air filter on the conduit 11.

Figure 5:
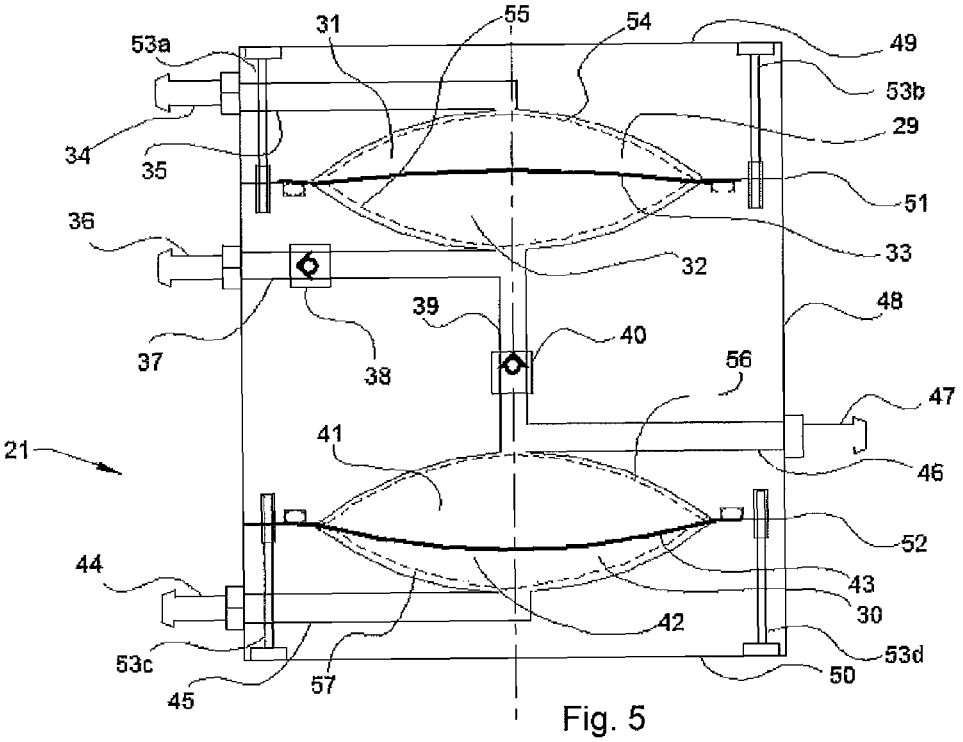
FIG. 5 shows the fluid reservoir of the ink system according to the invention.

FIG. 5 shows the fluid reservoir 21 according to the invention, comprising a first cavity 29 and a second cavity 30, the first cavity 29 being located gravitationally above the second cavity 30. The first cavity 29 is defined by a first end 49 which is joined by a first joint 53*a*, 53*b* to a central portion 48, and therebetween a first sealing surface 51. The second cavity 30 is defined by a second end 50 which is joined by a second joint 53*c*, 53*d* to the central portion 48, and therebetween a second sealing surface 52. The first cavity 29 is divided by a first membrane 33 to form a first chamber 31 and a second chamber 32. The first chamber 31 is connected to the control unit 18 via a first conduit 35 and a first connection 34. The second chamber 32 is connected to the fluid-container system 7, 8, 9, 11, 22 via a second conduit 37 comprising a first check valve 38 and an inlet port 36. The second cavity 30 is divided by a second membrane 43 to form a third chamber 41 and a fourth chamber 42. The third chamber 41 is connected to the second chamber 32 via a third conduit 39 comprising a second check valve 40. The third chamber 41 is connected via a fourth conduit 46 to an outlet port 47 to which a liquid consumer 5 is connected. The fourth chamber 42 is connected via a fifth conduit 45 and a second connection 44 to the media source 1 via the control unit 18 and the fourth hose 20 (see FIG. 6). The central portion 48 and the ends 49, 50 are joined by a first and a second joint 53*a-d*, here shown as screws threaded into the central portion 48. The joints 53*a-d* may also be throughbores so that, for example, a pair of opposing joints 53*b*, 53*d* are replaced by a screw. They may also be fewer or more than four, as shown in FIG. 5. The first membrane 33 can move between a first upper end position 54 and a first lower end position 55 adjacent to the upper and lower convex walls, respectively, of the first cavity 29. The second membrane 43 can move between the second upper end position 56 and the second lower end position 57 adjacent to the upper and lower convex walls, respectively, of the second cavity 30. In FIG. 5, the first end 49 with the first connection 34 and the second end 50 with the second connection 44 have been illustrated in an orientation different from that of FIG. 3 and FIG. 4, and it is understood that the way in which the connections to the fluid reservoir 21 are arranged is in no way to be construed as a limitation of the scope of protection. The seal of the sealing surfaces 51, 52 is preferably accomplished by means of an O-ring, or by both or one of the membranes 33, 43 being extended so as to also cover this area.

Figure 6:
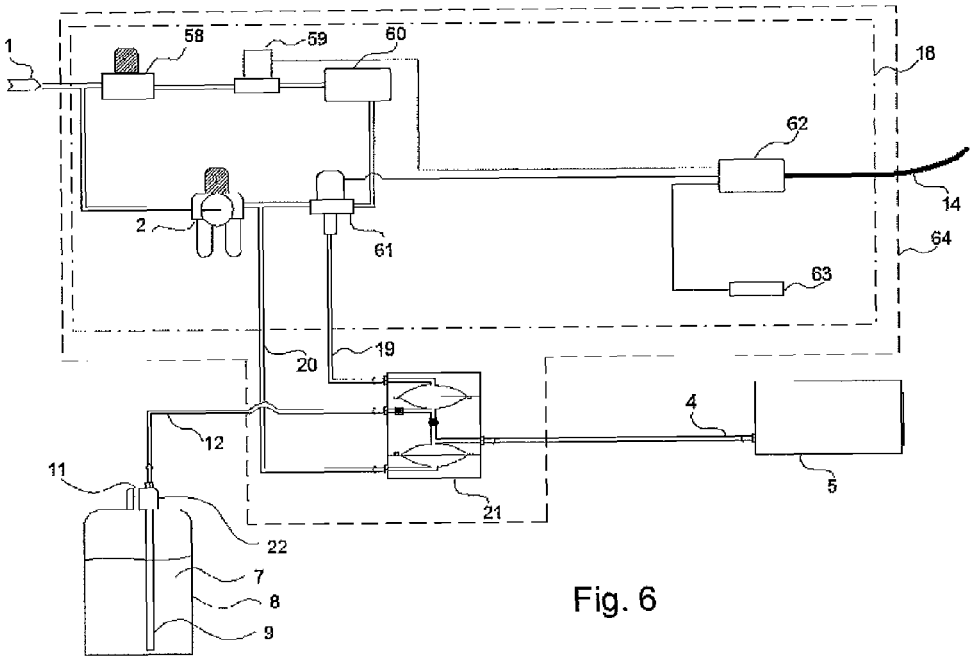
FIG. 6 shows a complete ink system according to the invention.

FIG. 6 shows an ink system 64 comprising an inventive fluid reservoir 21, a control unit 18, a fluid-container system 7, 8, 9, 11, 22 and a fluid consumer 5. The control unit 18 is connected to the fluid reservoir 21 via a third hose 19 and a fourth hose 20. The fluid-container system 7, 8, 9, 11, 22 is connected to the fluid reservoir 21 via a first hose 12 and the fluid consumer 5 is connected to the fluid reservoir via a second hose 4. As previously mentioned, the control system 18 comprises a vacuum system 58, 59, 60, and a pressurization system 2. The vacuum system comprises a first regulator 58, a first solenoid valve 59 and a vacuum injector 60. Compressed air for the vacuum system is obtained from an external compressed-air source 1, typically 4-10 bar, supplying the regulator 58, which down-regulates the pressure to normally 1-4 bar, feeding the air connection of the vacuum injector 60 via the first solenoid valve 59, which controls the vacuum injector 60. The vacuum connection of the vacuum injector 60 is connected to a second solenoid valve 61. The external compressed-air source 1 also supplies a second regulator 2 in the pressurization system. The second regulator 2 down-regulates the pressure of supplied compressed air to the working pressure of the ink, normally about 0.35-1.00 bar. The second regulator 2 is connected to the fourth hose 20 and the second solenoid valve 61. The second solenoid valve 61 controls the pressure in the third hose 19 using vacuum from the vacuum ejector 60 or pressure from the regulator 2. A controller 62 connected to a voltage source 14 controls the two solenoid valves 59, 61 which are operated simultaneously. Connected to the control 62 is a photocell 63. The fluid reservoir 21 draws ink 7 from a packaging 8 via a lance 9, a cover 22 and a first hose 12 to a second hose 4 feeding ink with a controlled pressure to an inkjet printer 5. The cover 22 has a conduit 11 communicating with the surrounding atmosphere in order to avoid the development of pressure below ambient pressure in the packaging 8 as the ink 7 is being drawn out. In FIG. 6, the upper end 49 with the first connection 34 and the second end 50 with the second connection 44 are illustrated in an orientation different from that of FIG. 3 and FIG. 4. In FIG. 6, filters have been omitted because they have nothing to do with the functional principle, and because they can have several alternative locations. Examples of locations are an ink filter directly before the print head on the second hose 4, and an air filter on the conduit 11.

Figure 7:
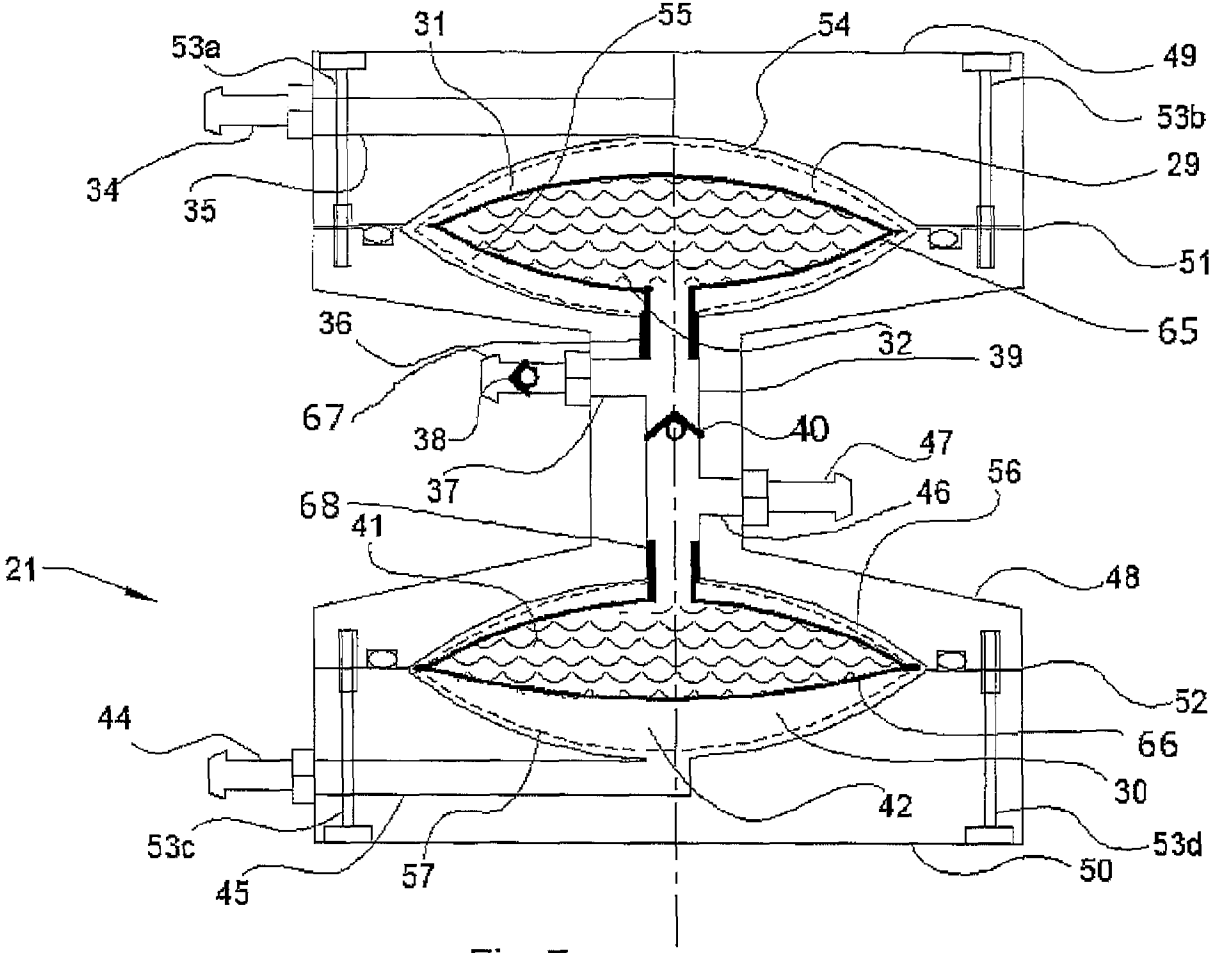
FIG. 7 shows an alternative design of the fluid reservoir of the ink system according to the invention.

FIG. 7 shows an alternative design of the fluid reservoir 21 of the ink system according to the invention. The main differences from FIG. 5 are that the first membrane 33 has been replaced by a first bag 65 and the second membrane 43 has been replaced by a second bag 66. A first chamber 31 is formed in the space outside the first bag 65 in the first cavity 29. A second chamber 32 is formed in the space inside the first bag 65. A third chamber 41 is formed in the space inside the second bag 66. A fourth chamber 42 is formed in the space outside the bag in the second cavity 30. The first check valve 38 can be integrated in the inlet port 36 on the outside of the central portion 48. It can also be integrated in the first hose 12, which is connected to the inlet port 36. The bags 65, 66 have spigots 67, 68 which are connected to the central portion 48.

In order to save material, the central portion 48 has been shaped as a tapered waist. The function of the fluid reservoir 21 and the ink system 64 according to the invention will now be described with reference to FIG. 5 and FIG. 6. The fluid reservoir 21 comprises two interconnected cavities 29, 30, a first cavity 29 and second cavity 30, the first cavity 29 being located gravitationally above the second cavity 30. The first cavity 29 has a suction function and the second cavity 30 has a pressure-retaining function. Feeding from the first cavity 29 to the second cavity 30 is accomplished by means of gravity. In this way, a supply of ink is obtained at the correct pressure level and with very small pressure fluctuations, less than ±0.05 bar, to an inkjet printer; thus a controlled pressure is achieved. This function will now be described in detail.

The second solenoid valve 61 is provided with pressure from the second regulator 2 and vacuum from the vacuum ejector 60. The third hose 19 is switched between pressure and vacuum by the second solenoid valve 61 at a switching rate of about 0.01-10 times per minute, normally about once per minute. The first chamber 31 is in communication with the second solenoid valve 61 via the first connection 34, the first conduit 35 and the third hose 19. When the first chamber 31 is in the vacuum phase, the first membrane 33 moves upwards. A pressure below ambient pressure develops in the second chamber 32, causing the second check valve 40 in the third conduit 39 to close and the first check valve 38 to open, and ink is drawn from the inlet port 36 connected to the packaging 8, causing the second chamber 32 to fill with ink. After the set time value in the controller 62 has been reached, the first membrane 33 has come close to or reached its first upper end position 54, whereupon the second solenoid valve 61 switches to the pressure phase. Thus, a pressure develops in the first chamber 31 and the first check valve 38 closes. The same pressure that is fed to the first chamber 31 via the third hose 19 is also fed to the fourth chamber 42 via the fourth hose 20. Because the second chamber 32 is gravitationally located above the third chamber 41, gravity creates a pressure difference between the second chamber 32 and the third chamber 41, causing the second check valve 40 to open and the ink to flow downwards to fill the third chamber 41. After the set time value in the controller 62 has been reached, the first membrane 33 has come close to or reached its first lower end position 55 and the second membrane 43 has come close to or reached its second lower end position 57, whereupon the solenoid valve 61 switches over to the vacuum phase, and the entire cycle is repeated. The fourth chamber 42 is under constant pressure from the second regulator 2, causing the ink to be fed with a controlled pressure to the outlet port 47 via the fourth conduit 46 and the second hose 4 to an inkjet printer 5.

The photocell 63 is an option which can be used to detect products to be marked by the inkjet printer, which sets the ink system 64 in sleep mode if no products pass through. Sleep mode means that the solenoid valve 61 sets itself so as to provide constant pressure in the third hose 19 and that the vacuum ejector 60 is turned off.

Because the ink system 64 draws the ink by suction, there is great freedom of choice for the packaging as the packaging 8 need not be pressurized and thus is not subject to the legal requirements relating to pressure vessels, which allows, inter alia, the use of the more environmentally friendly so-called "bag-in-box" packaging. The only legal requirement that must be met is that the packaging 8 must be approved for transporting the goods it contains. The volumes of the cavities 29, 30 are small enough not to be subject to the legislation relating to pressure vessels.

It is desirable to have the option of replacing the packaging without interrupting the supply of ink to the inkjet printer. This means that it is not necessary to interrupt the printing process in order to replace the packaging. In our ink system, this is accomplished by activating the "packaging replacement" function at the controller 62. The ink system 64 then interrupts its pumping function and is set in sleep mode, meaning that the solenoid valve 61 sets itself so as to provide constant pressure in the third hose 19 and that the vacuum ejector 60 is turned off. During replacement, the inkjet printer 5 is supplied by the volume contained in the third chamber 41 and the second chamber 32. When the packaging is replaced, the ink system 64 is activated at the controller 62.

In the ink system according to the invention, all electricity is kept separate from the ink. All electrical components have been concentrated to the control unit 18, which is installed outside the environment that may be explosive. The fluid reservoir 21 is preferably located adjacent to the head and in the environment which may be explosive, as it contains no electrical parts, but is powered and controlled by air hoses from the control unit 18.

The ink system 64 presents low shear forces and does not cause cavitation, which is explained by the fact that the fluid reservoir 21 operates at low vacuum levels. Because the fluid reservoir 21 has a large area in the first membrane 33 and a great displacement in the second chamber 32, sufficient ink flow can be achieved using a low pump frequency, which means that a low vacuum can be used. The suction force is determined by the vacuum level in the first chamber 31. The vacuum level is adjusted by the regulator 58, whereby adjustments can be made for variations in elevation of the location of the fluid packaging 8.

Alternative Embodiments

It is understood that any non-solid medium may be used for the pressurization and vacuumization of the first chamber 31, and for the pressurization of the fourth chamber 42, such as a liquid.

The preferred orientation of the cavities is where the first cavity 29 is located gravitationally straight above the second cavity 30, but the invention is not limited to this orientation. The pump works in other orientations of the cavities 29, 30 as well, but this leads to impaired flow and impaired pressure tolerance. For example, the cavities may be spaced apart and the central portion 48 comprising the third conduit 39 and the second check valve 40 may be replaced by a pipe connecting the cavities. Also, the first cavity 29 need not be located at a gravitationally higher level than the second cavity 30. Location of the cavities side by side on the same level and connected at the bottom via the third conduit 39 works according to the principle of communicating vessels.

The central portion 48 need not include the first conduit 37, but the first conduit 37 comprising the first check valve 38 may be directly connected to the second chamber 32 in the first cavity 29. Similarly, the second conduit 46 may be directly connected to the third chamber 41 in the second cavity 30.

The choice of materials for, and the design of, the membranes 33, 43 shall be made in such a way that they have a negligible self-resistance in terms of their movement in the cavities 29, 30. Otherwise, a non-controlled pressure results. The membranes 33, 43 are preferably made from a thin plastic foil having the same convex shape as the cavities 29, 30. Then the membranes 33, 43 can reach their end positions 54, 55, 56, 57 without tensioning. The membranes 33, 43 must present very good mechanical properties in terms of fatigue and be resistant to chemicals; therefore, examples of preferred plastics are polypropylene or polyethylene. However, other materials presenting suitable properties may also be considered. The accuracy of the second regulator 2 and the self-resistance of the membranes 33, 43 determine how well the pressure in the outlet port 47 is controlled. A preferred regulator is a so-called precision regulator. When the choices of regulator 2 and membranes 33, 43 are appropriate, a controlled pressure is obtained. The fluid reservoir 21 withstands high pressures and high vacuum levels, because the membranes are not exposed to increased load as a result of the ink 7 running out or high pressures in the third hose 19 and/or the fourth hose 20, or high vacuum in the third hose 19 because there is a medium on both sides of the membranes 33, 43, whose pressures cancel each other, but if the medium in any of the chambers 31, 32, 41, 42 disappears, a pressure situation may occur where the first membrane 33 reaches its first upper end position 54 or its first lower end position 55, and/or where the second membrane 43 reaches its second upper end position 56 or its second lower end position 57. This means that the membranes abut against and are supported by the wall of the convex cavities 29, 30. In order to ensure that the membranes 33, 43 are not exposed to damage, in the regions where the cavities 29, 30 are joined to the first, third and fifth conduits 35, 39, 45, when they have reached their upper or lower end positions 54, 55, 56, 57, it is possible, for example, to reinforce the membranes 33, 43 in these very regions. Another option could be for the opening, which is formed where the cavities 29, 30 are connected to the conduits 35, 39, 45, to have some kind of support; for example, a coarse mesh could cover the hole, which would then support the membranes 33, 43 when they have reached their upper and lower end positions 54, 55, 56, 57 respectively. The cavities 29, 30 are designed to be sufficiently robust to withstand the pressure that an external industrial compressed-air source 1 can generate. Thereby, the ink system 64 can provide a sufficiently high pressure to achieve good print quality, even if the packaging is located far below the inkjet printer.

The membranes 33, 43 in the cavities 29, 30 separate the ink 7 in the cavities 29, 30 from the compressed air 1. Thereby, any contamination by the absorption of gas from the pressurized air 1 is avoided, and it is possible to transport ink which is apt to react with air, or to maintain the low gas content in so-called degassed inks. However, this requires a modification of the packaging 8, which in its simplest embodiment is in contact with ambient air via the conduit 11 in the cover 22. Either a protective gas is added in the conduit 11, such as nitrogen or helium, which are inert, or a collapsible bag is selected as packaging 8, for example, a so-called "bag-in-box" packaging wherefrom air has been removed.

The use of a so-called gas-permeable membrane in the first cavity 29, i.e., a membrane which is permeable to gases such as oxygen, carbon dioxide and nitrogen gas, but consequently not liquid, could cause the ink drawn into the first cavity 29 to be degassed during the vacuum phase. It is understood that it is a great advantage to be able to integrate the degassing of the ink in a feeding operation. The sizes of the cavities 29, 30 in the fluid reservoir 21 are chosen so that, in relation to the flow to the fluid consumer 5, the time is sufficient for effective degassing. The degree of degassing can also be controlled by the first regulator 58, which controls the vacuum level of the vacuum injector 60.

An embodiment completely without membranes is also contemplated, but that requires very careful control of the ink level in the first cavity 29 to ensure it is not over-filled and ink is carried up into the third hose 19 and further up into the control system 18.

Degassing of ink can then be achieved in the first cavity 29 by providing the first conduit 37 with a shut-off valve as a supplement or alternative to the first check valve 38. Then, high vacuum can be allowed without ink being drawn further into the third hose 19 and further up into the control system 18.

In an embodiment with laterally arranged cavities according to the principle of communicating vessels, the pressure medium acts on the upper surface of the ink in both cavities 29, 30, and if an inert gas, such as nitrogen gas, is used as the pressure medium 1, it is understood that membranes can be dispensed with. Nevertheless, membranes can serve the purpose of protecting the ink against other pollutants, such as dust, which may be present in the pressure medium. Within the scope of the invention it is, of course, possible to combine membranes, no membrane or bag in the cavities based on what is found suitable. For example, membrane and bag constitute a combination, no membrane and membrane another, etc.

The check valve 40 in the third conduit 39 is closed during the vacuum phase, and the pressure in the fourth chamber 42 feeds the ink in the third chamber 41 into the fluid consumer 5. It is understood that in an embodiment where the second conduit 46 is connected directly to the third chamber 41, i.e., the third conduit 39 and the second conduit 46 are completely separated, the check valve may be disposed in the inlet to the third chamber 41. Similarly, the first check valve 38 could be disposed in a separate inlet for the first conduit 37 to the second chamber 32.

In accordance with the embodiment shown in FIG. 7, it is particularly suitable to arrange the check valve 40 in the inlet spigot 68 of the bag 66.

In order to release the pressure in both cavities 29, 30, a three-way valve for air bleeding may be installed directly after the second regulator 2, whereby a so-called "on-demand system" can be achieved.

The cavities 29, 30 may have another shape than that illustrated in FIG. 5. The preferred shape is convex, to support membranes or bags. The membranes 33, 43 and bags 65, 66 may have a different shape or be made of other materials than what is mentioned if they meet the same functional requirements.

The vacuum source can also be another than the above-mentioned vacuum system 58, 59, 60.

Of course the conduits 35, 37, 39, 45, 46 disposed in the fluid reservoir 21 and through which fluid 7 and pressure medium flow, need not be arranged as shown in the drawings. It is understood that these conduits can be designed with different routes through the ends 49, 50 and the central portion 48, as the shape of these parts can be varied as long as they withstand the pressure that can be generated by an external industrial compressed-air source 1. Likewise, it is understood that the shape of the cavities can be varied, making it possible to adapt the encompassing ends 49, 50 and the central portion 48 accordingly. Therefore, the connecting conduits may be routed through these parts differently from what is shown in the drawings.

In a contemplated variant of the control system 18, the second regulator 2 is disposed downstream of the first regulator 58, the benefit being increased protection against high pressure to the fluid reservoir 21.

It is understood that within the scope of the invention, connections other than hoses can be used; for example, it is possible to use pipes. It is further understood that the hoses or pipes may constitute means integrated in the fluid reservoir 21 for connecting peripheral equipment, or that the systems and components connected to the fluid reservoir 21, such as fluid-container systems, fluid consumers, control systems, can include these necessary means for interconnection.

The specifications of dimensions and materials given in the descriptions are not intended as characteristics and should not be construed as limitations of the invention.

The invention claimed is:

1. A fluid reservoir comprising: at least one first cavity and one second cavity in fluidic communication with each other and adapted to accommodate fluid, the fluid reservoir further being connected to a fluid-container system, a fluid consumer in fluidic communication with at least the second cavity, a pressurization system adapted to generate a pressure, and a vacuum system adapted to generate a pressure below ambient pressure, the fluid reservoir being designed so that either said pressurization system or vacuum system can be made to alternately affect the pressure in the first cavity, and the fluid reservoir being designed so that said pressurization system can be made to affect the pressure in the second cavity, that said vacuum system generates a pressure below ambient pressure in the first cavity, causing fluid from the fluid-container system to flow into the first cavity, that said pressurization system causes fluid in the first cavity to flow into the second cavity and generates a feed of fluid to the fluid consumer.

2. A fluid reservoir according to claim 1, wherein the fluid in the first cavity is caused to flow by gravity into the second cavity.

3. A fluid reservoir according to claim 1, wherein the pressurization system constantly affects the pressure in the second cavity.

4. A fluid reservoir according to claim 1, further comprising a first connection to a first conduit connected to the first cavity, that said pressurization system and vacuum system can be connected to the first cavity via a second solenoid valve and a third hose connected to the first connection.

5. A fluid reservoir according to claim 1, further comprising a second connection to a fifth conduit connected to the second cavity, that said pressurization system can be connected to the second cavity via a fourth hose.

6. A fluid reservoir according to claim 1, further comprising an inlet port to a second conduit connected to the first cavity for connection of a fluid-container system to said first cavity via a first hose.

7. A fluid reservoir according to claim 6, wherein a first check valve is disposed in the joint between said fluid-container system and said first cavity, preventing return flow of fluid to the fluid-container system when said pressurization system affects the pressure in the first cavity.

8. A fluid reservoir according to claim 1, wherein the first cavity is connected to the second cavity via a third conduit and a second check valve, that said check valve prevents return flow of fluid from the second cavity to the first cavity when said vacuum system affects the pressure in the first cavity.

9. A fluid reservoir according to claim 1, wherein the second cavity is connected via a fourth conduit to an outlet port to which the fluid consumer is connected via a second hose.

10. A fluid reservoir according to claim 1, wherein the first cavity is divided by a first membrane to form a first chamber and a second chamber and/or that the second cavity is divided by a second membrane to form a third chamber and a fourth chamber, optionally wherein the first membrane and/or the second membrane is/are made of a polymeric material.

11. A fluid reservoir according to claim 10, wherein the first membrane is installed between the first end and the central portion and/or the second membrane is installed between the second end and the central portion.

12. A fluid reservoir according to claim 10, wherein a third conduit and a fourth conduit are connected to the third chamber, and a fifth conduit is connected to said fourth chamber.

13. A fluid reservoir according to claim 10, wherein a sensor detects when the first membrane has reached a first upper end position and initiates the transition from vacuum phase to pressure phase.

14. A fluid reservoir according to claim 1, wherein the first cavity is divided by a first bag to form a first chamber and a second chamber and/or the second cavity is divided by a second bag to form a third chamber and a fourth chamber, optionally wherein the first bag and/or the second bag is/are made of a polymeric material.

15. A fluid reservoir according to claim 14, wherein a second conduit and a third conduit are connected to the second chamber, and a first conduit is connected to said first chamber.

16. A fluid reservoir according to claim 14, wherein a third conduit and a fourth conduit are connected to the third chamber, and a fifth conduit is connected to said fourth chamber.

17. A fluid reservoir according to claim 14, wherein a sensor detects when the first bag has reached a first upper end position and initiates the transition from vacuum phase to pressure phase.

18. A fluid reservoir according to claim 10, wherein a second conduit and a third conduit are connected to the second chamber, and a first conduit is connected to said first chamber.

19. A fluid reservoir according to claim 1, wherein the first cavity is defined by a first end which is joined by a joint to a central portion and therebetween a first sealing surface, and that the second cavity is defined by a second end which is joined by a joint to the central portion and therebetween a second sealing surface.

20. A fluid reservoir according to claim 19, wherein the sealing surfaces consist of an O-ring and/or a first membrane is extended to cover the first sealing surface and/or a second membrane is extended to cover the second sealing surface.

21. A fluid reservoir according to claim 1, wherein the media source of the pressure for the pressurization system is air whose pressure is substantially constant.

22. A fluid reservoir according to claim 1, wherein the media source of vacuum for the vacuum system is air.

23. A fluid-supply system for the supply of fluid from a fluid-container system to a fluid consumer, wherein the fluid-supply system comprises a fluid reservoir according to claim 1.

24. A fluid reservoir according to claim 1, wherein the fluid reservoir is used in a fluid-supply system for inkjet printers.

* * * * *